US010021929B1

(12) United States Patent
Kirschner

(10) Patent No.: US 10,021,929 B1
(45) Date of Patent: Jul. 17, 2018

(54) HAT WITH ATTACHED HAIR

(71) Applicant: ELEGANT HEADWEAR CO., INC., Elizabeth, NJ (US)

(72) Inventor: Hillel Kirschner, Elizabeth, NJ (US)

(73) Assignee: Elegant Headwear Co., Inc., Elizabeth, NJ (US)

( * ) Notice: Subject to any disclaimer, the term of this patent is extended or adjusted under 35 U.S.C. 154(b) by 0 days.

(21) Appl. No.: 14/720,208

(22) Filed: May 22, 2015

Related U.S. Application Data

(60) Provisional application No. 62/002,303, filed on May 23, 214.

(51) Int. Cl.
*A41G 5/00* (2006.01)
*A42B 1/24* (2006.01)

(52) U.S. Cl.
CPC ..... *A41G 5/0093* (2013.01); *A42B 1/242* (2013.01)

(58) Field of Classification Search
CPC ..... A41G 5/004; A41G 5/0093; A42B 1/242
See application file for complete search history.

(56) References Cited

U.S. PATENT DOCUMENTS

| | | | | |
|---|---|---|---|---|
| 1,315,313 A | | 9/1919 | Kraft | |
| D156,408 S | | 12/1949 | Cohn | |
| D162,965 S | | 4/1951 | Krieger | |
| 2,648,847 A | | 8/1953 | Crowder | |
| 2,730,722 A | | 1/1956 | Colangelo | |
| 2,735,109 A | | 2/1956 | Feldman | |
| 2,847,016 A | | 9/1958 | Rabinowitz | |
| 2,864,383 A | | 12/1958 | Jacks et al. | |
| 3,199,516 A | | 8/1965 | Frishman | |
| 3,242,501 A | | 3/1966 | Lish | |
| 3,295,536 A | | 1/1967 | Shaw et al. | |
| 3,385,305 A | | 5/1968 | Buzzelli | |
| 3,460,546 A | | 8/1969 | Abbott | |
| 3,550,161 A | * | 12/1970 | Orozco | A42B 1/004 132/53 |
| 3,557,806 A | | 1/1971 | Blanchard | |
| 3,636,962 A | | 1/1972 | Frackowiak | |
| 3,758,771 A | * | 9/1973 | Frohardt | A44C 15/0015 116/DIG. 5 |
| 3,782,396 A | | 1/1974 | Tomlinson | |
| 4,074,365 A | | 2/1978 | Schuessler et al. | |
| D258,323 S | | 2/1981 | Lewis | |
| 4,268,918 A | | 5/1981 | Lee | |

(Continued)

*Primary Examiner* — Khoa Huynh
*Assistant Examiner* — Jocelyn Bravo
(74) *Attorney, Agent, or Firm* — Galgano IP Law PLLC; Thomas M. Galgano

(57) ABSTRACT

A hat having attached hair including a baseball cap style hat with a dome-shaped crown having a front, a rear, and a lower opening for the head of the wearer. The hat further including a bill extending outwardly from the front of the crown. The rear of the crown having a semicircular shaped opening, generally adjacent to the lower edge of the crown. The hat also including a rectangular netting attached generally adjacent to the rear opening of the crown and a plurality of strands of hair wefted onto the netting in a plurality of parallel tracks, with the hair extending downwardly from the netting and outwardly through the semicircular shaped opening in the crown of the hat. Furthermore, the hat including indicia imprinted on the bill and the crown of the hat and optionally LED lights incorporated into the hair.

12 Claims, 4 Drawing Sheets

(56) References Cited

U.S. PATENT DOCUMENTS

D289,093 S 3/1987 Walker
4,781,647 A * 11/1988 Doane, Jr. ..... A63H 3/44 132/53
4,985,935 A 1/1991 Hur
5,170,509 A 12/1992 Leopold
D336,970 S 7/1993 Reber
5,239,705 A * 8/1993 Leopold ..... A41G 5/0093 132/273
5,321,854 A 6/1994 Kronenberger
5,337,763 A 8/1994 Haber
5,348,510 A 9/1994 DuPont et al.
D357,343 S 4/1995 O'Neal et al.
5,493,735 A 2/1996 Rice
5,511,249 A 4/1996 Higgins
5,542,127 A 8/1996 Bezanis
5,632,047 A 5/1997 Van Den Heuvel
5,644,799 A 7/1997 Armenta et al.
5,666,670 A 9/1997 Ryan
D389,958 S 1/1998 Kinkead
5,819,319 A 10/1998 Spurs
D405,590 S 2/1999 Bartz
D406,189 S 3/1999 Hosogai
5,875,494 A 3/1999 Garnier, Jr. et al.
5,878,756 A 3/1999 Bilodeau
D409,822 S 5/1999 Humphrey
5,899,211 A 5/1999 Brown
D411,577 S 6/1999 Walker et al.
5,926,848 A 7/1999 Bartholomae
D413,191 S 8/1999 Thomas
5,933,872 A * 8/1999 Lema ..... A42B 1/225 2/209.3
D430,386 S 9/2000 Necatera
6,401,255 B1 6/2002 Douglas
D467,056 S 12/2002 Rothschild
6,662,806 B2 12/2003 Nakane et al.
6,711,749 B2 3/2004 White
6,830,054 B1 12/2004 Ross-Kuehn
D501,281 S 1/2005 Kole
6,910,226 B2 6/2005 Hoyez
7,047,571 B1 5/2006 Kelly
D522,215 S 6/2006 Rothschild
7,096,510 B2 8/2006 Yeadon
D539,483 S 3/2007 Arnold
D557,478 S 12/2007 Nance
D561,939 S 2/2008 Madden
7,454,799 B2 11/2008 Wuensche
D592,832 S 5/2009 Radell
D595,033 S 6/2009 Lynn
D596,380 S 7/2009 Chiappa-Wilson
D605,379 S 12/2009 James
D619,336 S 7/2010 Eyl
7,836,523 B2 11/2010 Castle
D631,641 S 2/2011 Pikus-Pace
8,028,349 B2 10/2011 Petzl
D669,224 S 10/2012 Morris
D674,968 S 1/2013 Morris
D675,402 S 2/2013 King
8,418,266 B1 * 4/2013 Pike ..... A41G 5/0093 2/195.1
8,584,682 B1 11/2013 Naylor
D697,288 S 1/2014 Pearson
D703,385 S 4/2014 Adams
2003/0156429 A1 * 8/2003 MacDonald ..... A45D 8/20 362/570
2005/0268927 A1 12/2005 Alcala
2006/0117461 A1 * 6/2006 Kelly ..... A42B 1/004 2/209.13
2006/0174905 A1 9/2006 Bias
2007/0283975 A1 * 12/2007 Ma ..... A41G 5/0093 132/53
2008/0092272 A1 4/2008 Vainio et al.
2009/0235943 A1 9/2009 Sugai
2011/0209719 A1 * 9/2011 Anzivino ..... A41G 5/0073 132/53
2014/0189933 A1 7/2014 Toronto

* cited by examiner

HAT WITH ATTACHED HAIR

CROSS-REFERENCE TO RELATED APPLICATION

This application claims benefit from U.S. Provisional Patent Application Ser. No. 62/002,303, filed May 23, 2014, the contents of which are hereby incorporated by reference.

BACKGROUND OF THE INVENTION

1. Field of the Invention

The invention is generally in the field of accessories and, in particular, hats and caps. Specifically, the present invention is directed to a hat or cap having hair attached to it and extending outwardly from the rear opening in the cap and which hair can assume, for example, a ponytail or braid configuration. Optionally, the hat further includes LED lights incorporated into the hair.

2. Brief Description of the Prior Art

Various styles of caps and hats are well known as well as certain hats with hair attached thereto. However, it is desirable to have a fashion or novelty hat with hair attached thereto with the appearance of the wearer's natural hair. It is also desirable to provide a novelty hat with indicia and/or ornamentation thereon, and preferably which corresponds to the attached hair. It is also desirable to have a novelty hat having means for lighting incorporated into the hair attached to the hat. While the prior art discloses many types of hats and caps, so far as is known, none of these assemblies provide for the novel hats with attached hair, as in the present invention.

SUMMARY OF THE INVENTION

Accordingly, it is an object of the present invention to provide a novel hat having attached hair.

It is also an object of the present invention to provide a hat having attached hair which is in the form of a ponytail, braid, or combination of ponytail and braids.

It is another object of the present invention to provide a hat having attached hair in which the hair is attached to the inside of the hat generally adjacent to a rear opening in the hat, so that the hair extends outwardly through the rear opening of the hat.

It is yet another object of the present invention to provide a hat having attached hair with indicia and/or three-dimensional ornamentation on the crown and/or bill of the hat.

It is a further object of the present invention to provide a hat having attached hair where the indicia on the bill and crown form a single unitary image and correspond with the attached hair.

Additionally, it is an object of the present invention to provide a hat with LED lights incorporated into the hair attached to the hat.

Certain of the foregoing and related objects are readily attained by the present invention by the provision of a hat having attached hair, comprising a baseball cap style hat comprising a dome-shaped crown removably receivable over the head of a wearer, said crown having a front portion, a rear portion, a lower edge defining a lower opening therebetween for the head of the wearer, an inside surface, an outside surface, and a bill attached to said front portion of said crown and extending outwardly from said lower edge of said front portion of said crown, wherein said rear portion of said crown defines a rear opening therein, generally adjacent to said lower edge of said crown; and hair attached to said inside surface of said rear portion of said crown, generally adjacent to said rear opening defined in said crown, such that said hair extends outwardly and downwardly from said crown through said rear opening defined therein. In the preferred embodiment, hair is permanently attached to said inside surface of said crown of said hat.

Preferably, said hair is in the form of a member selected from the group consisting of a ponytail, at least one braid, and a combination of ponytail and at least one braid. Desirably, the hat further comprises a flexible netting attached to said hat, and wherein said hair comprises a plurality of strands of hair wefted onto said netting. Advantageously, said plurality of strands of hair are wefted onto said netting in a plurality of generally parallel tracks which are stitched onto said netting. In the preferred embodiment, said netting is generally rectangularly-shaped having four side edges, wherein one of said side edges of said netting is attached to said hat generally adjacent to said rear opening defined in said rear portion of said crown.

It is also desirable that said rear opening defined in said rear portion of said crown is generally semicircular shaped and is defined by an arch-shaped upper edge having a first end and an opposite second end and an elastic band extending from said first end to said second end of said arch-shaped upper edge and wherein one of said side edges of said netting is attached to said crown in an arch shape, generally adjacent to said arch-shaped upper edge. In the preferred embodiment, said hair is synthetic.

It is also desirable that at least one of said crown and said bill of said hat are imprinted with indicia. Preferably, at least one of said crown and said bill of said hat further comprise ornamentation affixed thereto. It is further preferred that at least one of said ornamentation is three-dimensional. Desirably, both of said crown and said bill of said hat are imprinted with indicia and said indicia on said bill and said crown form an overall unitary image.

In a preferred embodiment, the hat further comprises means for lighting incorporated into said hair. Preferably, said means for lighting comprises at least one strand of a plurality of electrically powered LED lights woven into said hair. Desirably, said plurality of LED lights are intermittent. Advantageously, said plurality of LED lights are colored.

Certain of the foregoing and related objects are also readily attained by the present invention by the provision of a hat having attached hair, comprising a hat removably receivable over the head of a wearer; hair attached to said hat; and means for lighting incorporated into said hair. Preferably, said means for lighting comprises at least one strand of a plurality of electrically powered LED lights woven into said hair. It is also desirable that said plurality of LED lights are intermittent. Advantageously, said plurality of LED lights are colored.

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

DETAILED DESCRIPTION OF THE PREFERRED EMBODIMENTS

Figure 1:
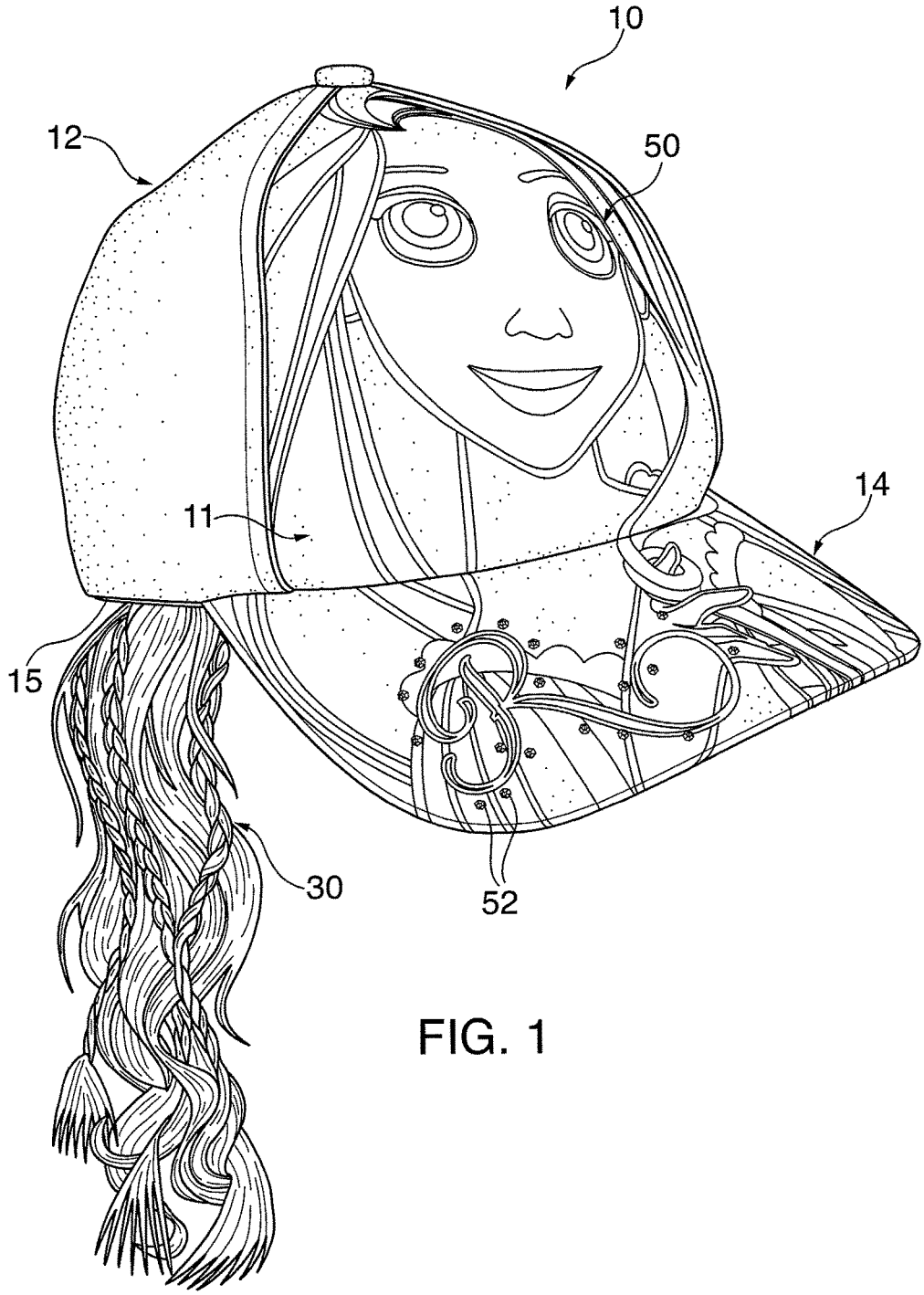
FIG. 1 is a front and left side perspective view of a first embodiment of a hat with attached hair, according to the present invention, having an attached ponytail with braids therein and indica and ornamentation on the crown and bill of the hat.
Figure 2:
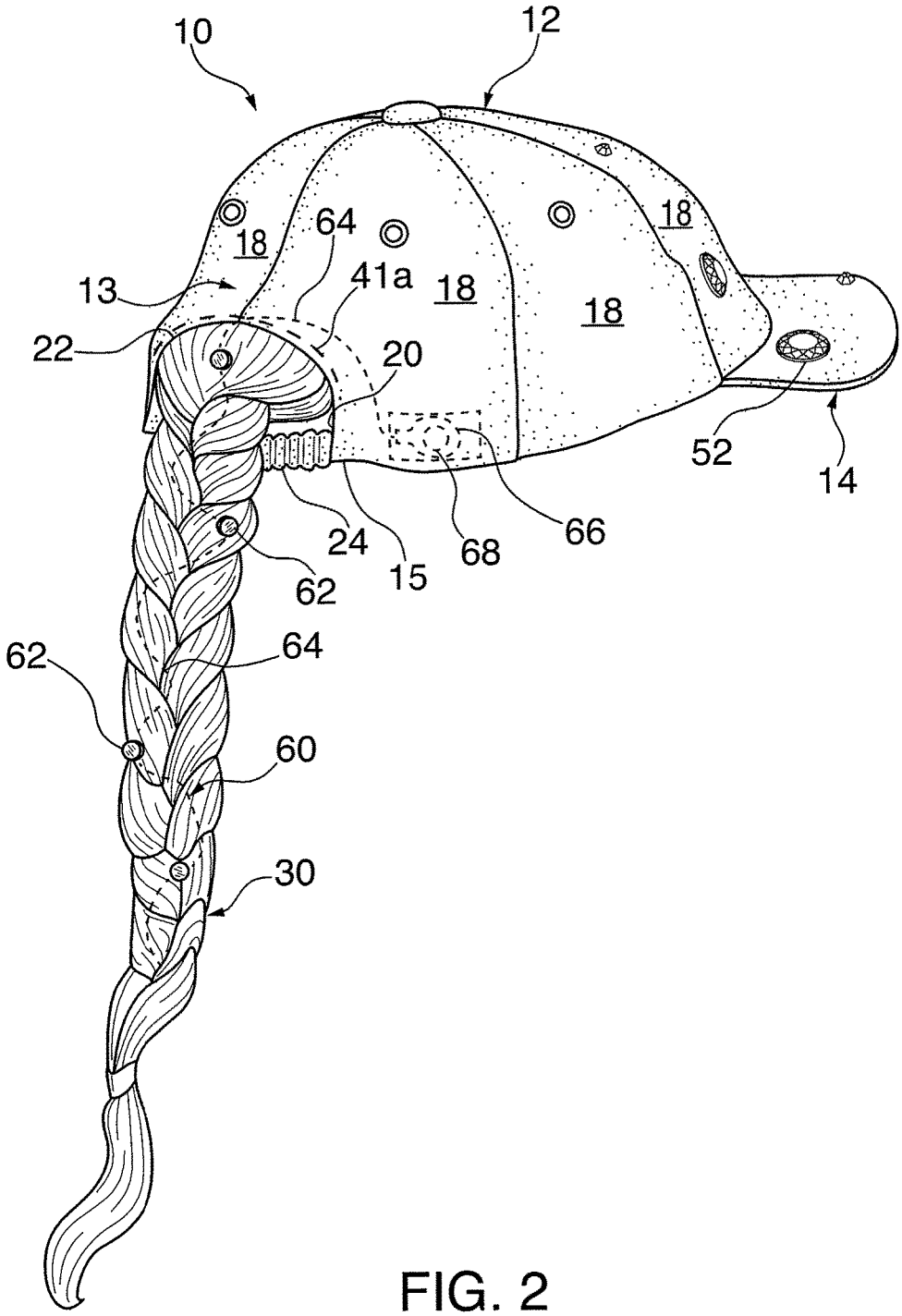
FIG. 2 is a rear and left side perspective view of a second embodiment of a hat with attached hair, with the hair in the form of a single braid and with LED lights incorporated into the hair.

Turning now in detail to the drawings and, in particular FIG. 1, which illustrates a hat or baseball cap having attached hair, according to the present invention, generally designated by reference numeral 10. As seen in FIG. 1, hat 10 is a conventional baseball cap style hat which is removably receivable over the head of a wearer (not shown). As shown in FIG. 1, hat 10 includes a crown portion 12 and a brim or bill 14. Crown 12 is generally dome-shaped and has a front portion 11, an opposite rear portion 13, and a lower edge 15 defining a lower opening therebetween for receipt of the wearer's head therein (not shown). Preferably, as shown in FIG. 2, crown 12 is formed by five generally triangularly-shaped panels 18 stitched together, however, other suitable means of forming hat 10 may be utilized. Furthermore, crown 12 includes an inside surface which rests atop the wearer's head and an opposite outside surface which is visible when worn.

As seen in FIG. 1, front portion 11 of crown 12 includes bill 14 extending generally horizontally outwardly from lower edge 15. While hat 10 is shown as a baseball cap style hat, it can be appreciated that hat 10 can assume different configurations and other styles of hats can be utilized according to the present invention, such as for example, beanies, fedoras, etc. In a preferred embodiment, crown 12 and bill 14 are made of a microfiber or cotton twill fabric. However, it can be appreciated that other suitable fabrics or materials may be utilized.

Figure 3:
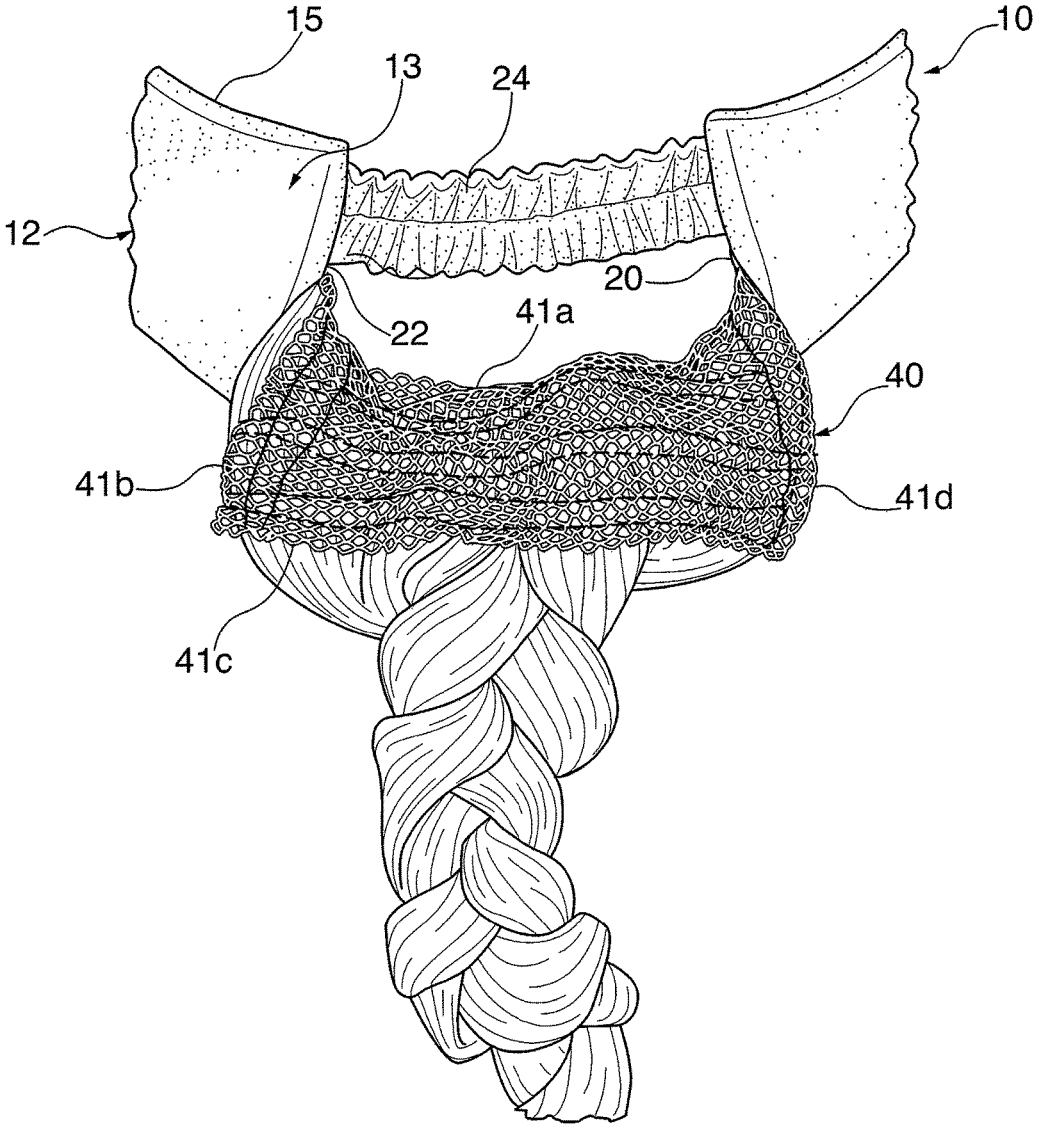
FIG. 3 is an elevational view of the rear of the hat with the netting with attached hair attached to the inside of the hat adjacent to the rear opening formed in the crown.

As seen best in FIGS. 2 and 3, hat 10 also has a rear opening 20 formed in the rear portion 13 of hat 10, generally adjacent to lower edge 15. In a preferred embodiment of the present invention, as illustrated in FIG. 2, the rear opening 20 is semicircular shaped and is defined by an arch-shaped curved upper edge 22 and an elastic band 24 extending across the lower edge thereof. Elastic band 24 is secured on either end to rear portion 13 of crown 12, and allows hat 10 to adjust to different sizes. While rear opening 20 is semicircular shaped, it can assume various other shapes and configurations and its exact placement on crown 12 can vary.

Additionally, as seen best in FIG. 2, hat 10 of the present invention has hair, generally designated by reference numeral 30, attached thereto, and extending downwardly from crown 12. In the preferred embodiment, hair 30 is synthetic hair and is permanently attached to hat 10. Furthermore, as seen best in FIG. 1, hair 30 can assume the overall form of a ponytail. As seen in FIG. 2, hair 30 can assume a braid configuration. Furthermore, as seen in FIG. 1, hair 30 can assume a configuration of a ponytail having a plurality of braids therein. While the drawings illustrate braid and ponytail styling configurations for hair 30, it can be appreciated that the styling of hair 30 can vary and can assume any number of styles, for example, pigtails or braided pigtails. Hair 30 can also be of any variety of colors and multiple colors of hair can be attached to hat 10.

In the preferred embodiment, as shown in FIGS. 2 and 3 hair 30 is attached to the inside surface of the rear portion 13 of crown 12, adjacent to rear opening 20 so that the hair 30 protrudes outwardly from crown 12, through rear opening 20, and extends downwardly therefrom, as seen in FIG. 2. Therefore, as seen in FIG. 2, hair 30 assumes the appearance of the natural hair of the wearer.

Figure 4:
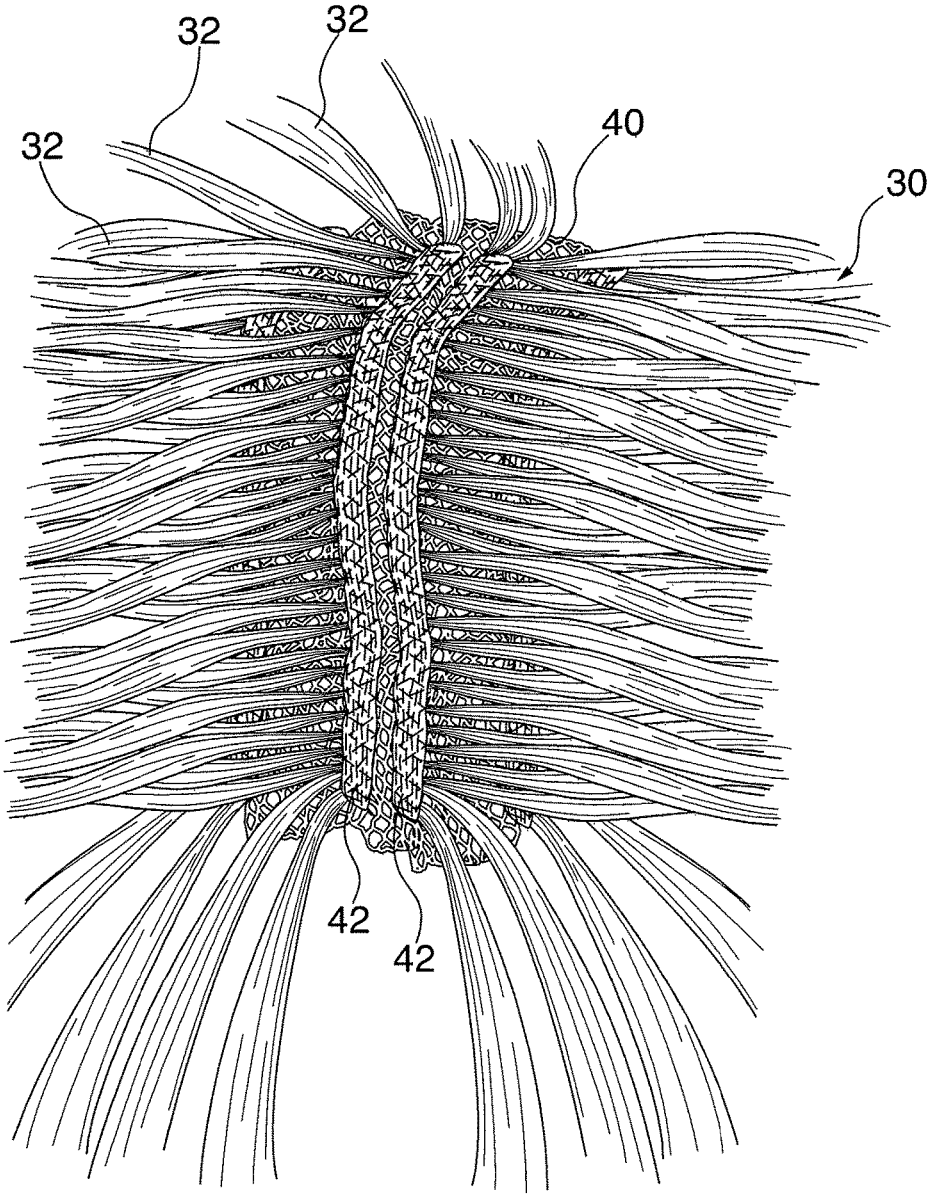
FIG. 4 is an enlarged view of the hair wefted into tracks and stitched onto the netting in a plurality of rows.

As seen best in FIG. 4, the hair 30 comprises a plurality of individual strands of hair 32 which are welted onto a flexible netting 40, which is attached to hat 10. More particularly, as seen in FIG. 4, the strands of hair 32 are wefted into a plurality of tracks of hair 42 which are then stitched onto netting 40. As also seen in FIGS. 3 and 4, in the preferred embodiment, netting 40 is generally rectangularly shaped and tracks 42 are stitched onto netting 40 in a plurality of parallel rows. While it is shown that the hair 30 is attached to netting 40 which is then attached to hat 10, it can be appreciated that the manner of attachment of hair 30 to netting 40 and/or hair 30 to hat 10 can vary and such means of attachment of hair 30 to hat 10 would be well know to one having ordinary skill in the art.

In the preferred embodiment shown in FIG. 3, netting 40 is generally rectangular shaped and has four side edges 41*a*, 41*b*, 41*c*, and 41*d*. As shown in FIGS. 2 and 3, side 41*a* of netting 40 is sewn in an arch shape onto the inside surface of crown 12, along and adjacent to arch-shaped curved edge 22, to allow hair 30 to extend outwardly through rear opening 20. In the embodiment shown in FIGS. 2 and 3, edge 41*a* of netting 40 is stitched along the inner edge of curved edge 22 of rear opening 20 in an arched-shaped orientation to correspond to the arch-shaped curve of edge 22. It can be appreciated that the exact manner of the attachment of hair 30 to crown 12 may vary as well as the exact location of attachment of hair 30 to crown 12.

Furthermore, as seen in FIG. 1, hat 10 is imprinted with various indicia 50 on crown 12 and/or bill 14 such as, for example, designs pertaining to different cartoon characters, movie or television characters, wordings, images, or letters. The indicia 50 may also include other ornamentation such as, for example, rhinestone studs 52, faux gems, glitter, eyelets, embroidery, or other three-dimensional ornamentation and can be placed at any locations on hat 10. In a preferred embodiment, as seen in FIG. 1, the indicia 50 on bill 14 and crown 12 form a single unitary image with a portion of the image on bill 14 and the corresponding other portion of the image on front portion 11 of crown 12.

It is also preferable that the indicia 50 on hat 10 coordinates with the attached hair 30. For example, hat 10 may include a design of cartoon princess character and the attached hair 30 coordinates with that particular character's style and color of hair. The color of the hat 10 and hair 30 can be any variety of different colors, as desired. Additionally, hat 10 can also include other decorative accents on the crown 12 and/or bill 14 such as, for example, a three dimensional tiara crown (not shown) affixed to crown 12 of hat 10. It can be appreciated that the indicia, ornamentation, and decorative elements of the hat 10 can be modified and varied.

In another preferred embodiment of the present invention as shown in FIG. 2, hat 10 further comprises means for lighting incorporated into the attached hair 30. Particularly, the means for lighting comprise at least one strand 60 of a plurality of LED lights 62 which are interconnected by a wire 64, and are woven into hair 30. Particularly, as seen in FIG. 2, strand 60 is woven into the hair 30. While a single strand 60 is illustrated, it can be appreciated that more than one strand 60 can be incorporated into hair 30.

In the preferred embodiment, wire 64 is a clear filament so that it more easily blends into hair 30. LED lights 62 are electrically powered and connected to a battery 66 incorporated into hat 10. Preferably, battery 66 is incorporated into crown portion 12 and is connected by wire 64 to LED lights 62. LED lights 62 can be various colors and can have different stages of blinking patterns and can selectively alternate between, for example, an on position, various patterns of intermittent blinking, streaming pattern, twinkling, alternate blinking, and/or an off position. A switch 68 can be utilized to control the LED lights, by turning them on and off or scrolling through the various blinking patterns. Such means for electrically connecting the LED lights together as well as to the source of electrical power, such as battery 66 and switch 68, are well known to those having ordinary skill in the art.

While particular embodiments of the invention have been described, it is not intended that the invention be limited thereto, as it is intended that the invention be as broad in scope as the prior art will allow and that the specification be read likewise. It will therefore be appreciated by those skilled in the art that other modifications could be made thereto without departing from the spirit and scope of the invention.

What is claimed is:

1. A hat having attached hair, comprising:

a baseball cap style hat comprising a dome-shaped crown removably receivable over the head of a wearer, said crown having a front portion, a rear portion, a lower edge defining a lower opening therebetween for the head of the wearer, an inside surface, an outside surface, and a bill attached to said front portion of said crown and extending outwardly from said lower edge of said front portion of said crown, wherein said rear portion of said crown defines a rear opening therein, generally adjacent to said lower edge of said crown, and wherein said rear opening defined in said rear portion of said crown is generally semicircular shaped and is defined by a semicircular-shaped upper edge having a first end and an opposite second end, and an elastic band extending from said first end to said second end of said semicircular-shaped upper edge;

a generally rectangular-shaped, flexible netting permanently attached to said hat with stitches, said netting having four side edges and wherein a first side edge of said four side edges of said netting has a first end and an opposite second end; and a plurality of strands of hair wefted onto said netting;

wherein said first side edge of said netting is attached to said inside surface of said rear portion of said crown with stitches in a semicircular shape, along and adjacent to said semicircular-shaped upper edge of said rear opening defined in said crown with said first end of said first side edge of said netting attached adjacent to said first end of said semicircular-shaped upper edge and said second end of one of said side edges of said netting attached adjacent to said second end of said semicircular-shaped upper edge, and the remaining three side edges of said netting are unattached to said cap, such that said plurality of strands of hair extend outwardly and downwardly from said crown through said rear opening defined therein.

2. The hat according to claim 1, wherein:

said hair is in the form of a member selected from the group consisting of a ponytail, at least one braid, and a combination of ponytail and at least one braid.

3. The hat according to claim 1, wherein:

said plurality of strands of hair are wefted onto said netting in a plurality of generally parallel tracks which are connected to said netting with stitches.

4. The hat according to claim 1, wherein:

said hair is synthetic.

5. The hat according to claim 1, wherein:

at least one of said crown and said bill of said hat are imprinted with indicia.

6. The hat according to claim 1, wherein:

at least one of said crown and said bill of said hat further comprise ornamentation affixed thereto.

7. The hat according to claim 6, wherein:

at least one of said ornamentation is three-dimensional.

8. The hat according to claim 5, wherein:

both of said crown and said bill of said hat are imprinted with indicia and said indicia on said bill and said crown form an overall unitary image.

9. The hat according to claim 1, further comprising:

means for lighting incorporated into said hair.

10. The hat according to claim 9, wherein:

said means for lighting comprises at least one strand of a plurality of electrically powered LED lights woven into said hair.

11. The hat according to claim 10, wherein:

said plurality of LED lights are intermittent.

12. The hat according to claim 10, wherein:

said plurality of LED lights are colored.

* * * * *